US011273096B2

(12) United States Patent
Watson

(10) Patent No.: US 11,273,096 B2
(45) Date of Patent: Mar. 15, 2022

(54) MASSAGING TABLE ASSEMBLY

(71) Applicant: Gary Watson, Tacoma, WA (US)

(72) Inventor: Gary Watson, Tacoma, WA (US)

( * ) Notice: Subject to any disclaimer, the term of this patent is extended or adjusted under 35 U.S.C. 154(b) by 324 days.

(21) Appl. No.: 16/567,988

(22) Filed: Sep. 11, 2019

(65) Prior Publication Data

US 2021/0069057 A1 Mar. 11, 2021

(51) Int. Cl.
*A61H 15/00* (2006.01)
*A47C 21/00* (2006.01)

(52) U.S. Cl.
CPC ..... *A61H 15/00* (2013.01); *A47C 21/006* (2013.01); *A61H 2015/0014* (2013.01); *A61H 2201/0142* (2013.01); *A61H 2201/0192* (2013.01); *A61H 2201/1253* (2013.01); *A61H 2201/1635* (2013.01); *A61H 2201/1676* (2013.01); *A61H 2203/0456* (2013.01); *A61H 2205/081* (2013.01)

(58) Field of Classification Search
CPC ..... A61H 15/00; A61H 2015/0007; A61H 2015/0014; A61H 2015/0021; A61H 2015/0028; A61H 2015/0035; A61H 2015/0042; A61H 2015/004; A61H 2015/0064; A47C 7/72; A47C 9/002; A47C 15/004; A61G 7/005; A61G 7/008; A61G 7/015
See application file for complete search history.

(56) References Cited

U.S. PATENT DOCUMENTS

| | | | | |
|---|---|---|---|---|
| 1,098,327 | A | 5/1914 | Koch | |
| 1,593,014 | A | 7/1926 | Bushmiller | |
| 1,748,425 | A | 2/1930 | Odell | |
| 3,039,458 | A * | 6/1962 | Hill | A61H 15/0078 601/116 |
| 3,759,250 | A | 9/1973 | Salata | |
| 5,505,691 | A | 4/1996 | Fenkell | |
| 5,634,887 | A | 6/1997 | Fortier | |
| 5,772,614 | A * | 6/1998 | Lindquist | A63B 21/00196 601/116 |
| 6,190,338 | B1 * | 2/2001 | Arndt | A61H 1/00 601/102 |
| 6,390,997 | B1 | 5/2002 | Vitko | |
| 8,287,439 | B2 * | 10/2012 | Evans | A63B 23/0233 482/145 |
| 2001/0039390 | A1 | 11/2001 | Barrett | |
| 2008/0227610 | A1 * | 9/2008 | Chen | A61H 1/0292 482/143 |
| 2010/0145240 | A1 | 6/2010 | Cromie | |
| 2011/0040219 | A1 * | 2/2011 | Tanner | A61H 1/0292 601/128 |
| 2014/0221881 | A1 * | 8/2014 | Schlauder | A63B 21/00069 601/23 |

* cited by examiner

*Primary Examiner* — Bradley H Philips
*Assistant Examiner* — Savannah L Gabriel

(57) ABSTRACT

A massaging table assembly for massaging a user's body includes a table that is positionable at an angle on a support surface for having a user lie thereon. The table has an opening therein. A rocker unit is pivotally coupled to the table and the rocker unit is positioned in the opening in the table. Moreover, the rocker unit is tiltable to a variety of angles with respect to the table. A pair of rollers is each rotatably coupled to the rocker units. Each of the rollers can massage the user's body when the user lies on the table.

10 Claims, 5 Drawing Sheets

MASSAGING TABLE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to massaging devices and more particularly pertains to a new massaging device for massaging a user's body.

(2) Description of Related Art Including Information Disclosed Under 37 CFR 1.97 and 1.98

The prior art relates to massaging devices.

BRIEF SUMMARY OF THE INVENTION

An embodiment of the disclosure meets the needs presented above by generally comprising a table that is positionable at an angle on a support surface for having a user lie thereon. The table has an opening therein. A rocker unit is pivotally coupled to the table and the rocker unit is positioned in the opening in the table. Moreover, the rocker unit is tiltable to a variety of angles with respect to the table. A pair of rollers is each rotatably coupled to the rocker units. Each of the rollers can massage the user's body when the user lies on the table.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
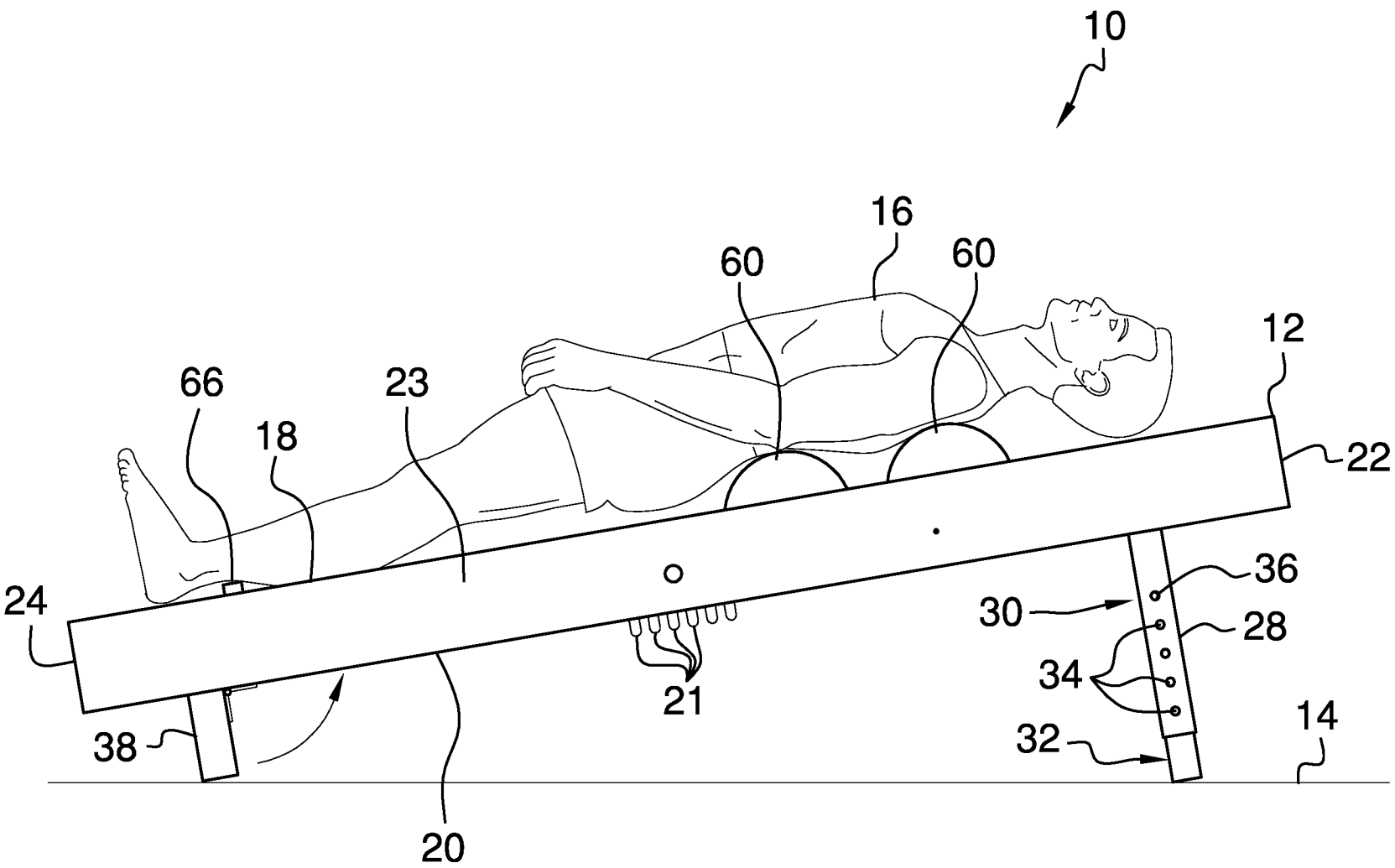
FIG. 1 is a perspective in-use view of a massaging table assembly according to an embodiment of the disclosure.
Figure 2:
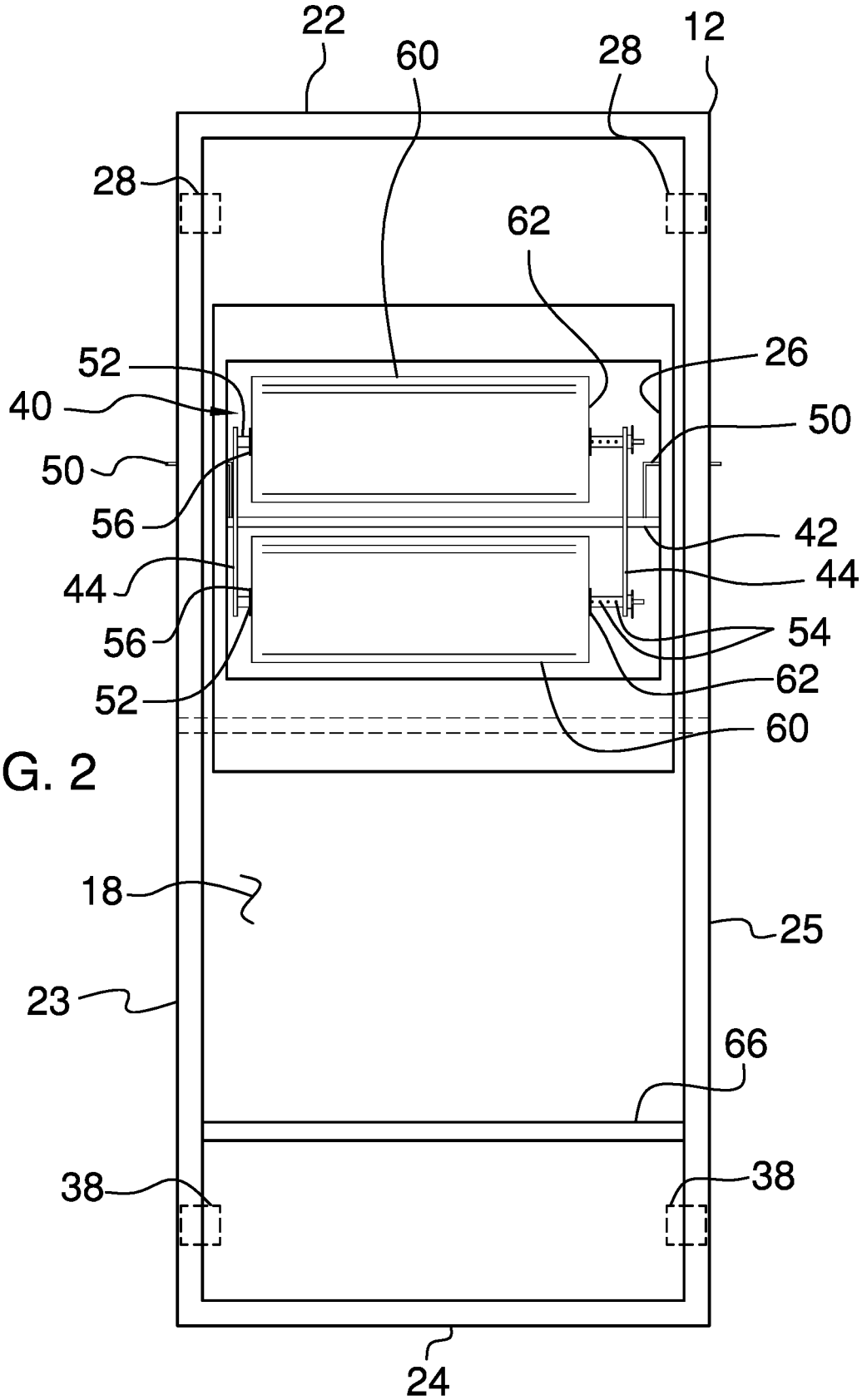
FIG. 2 is a top view of an embodiment of the disclosure.
Figure 3:
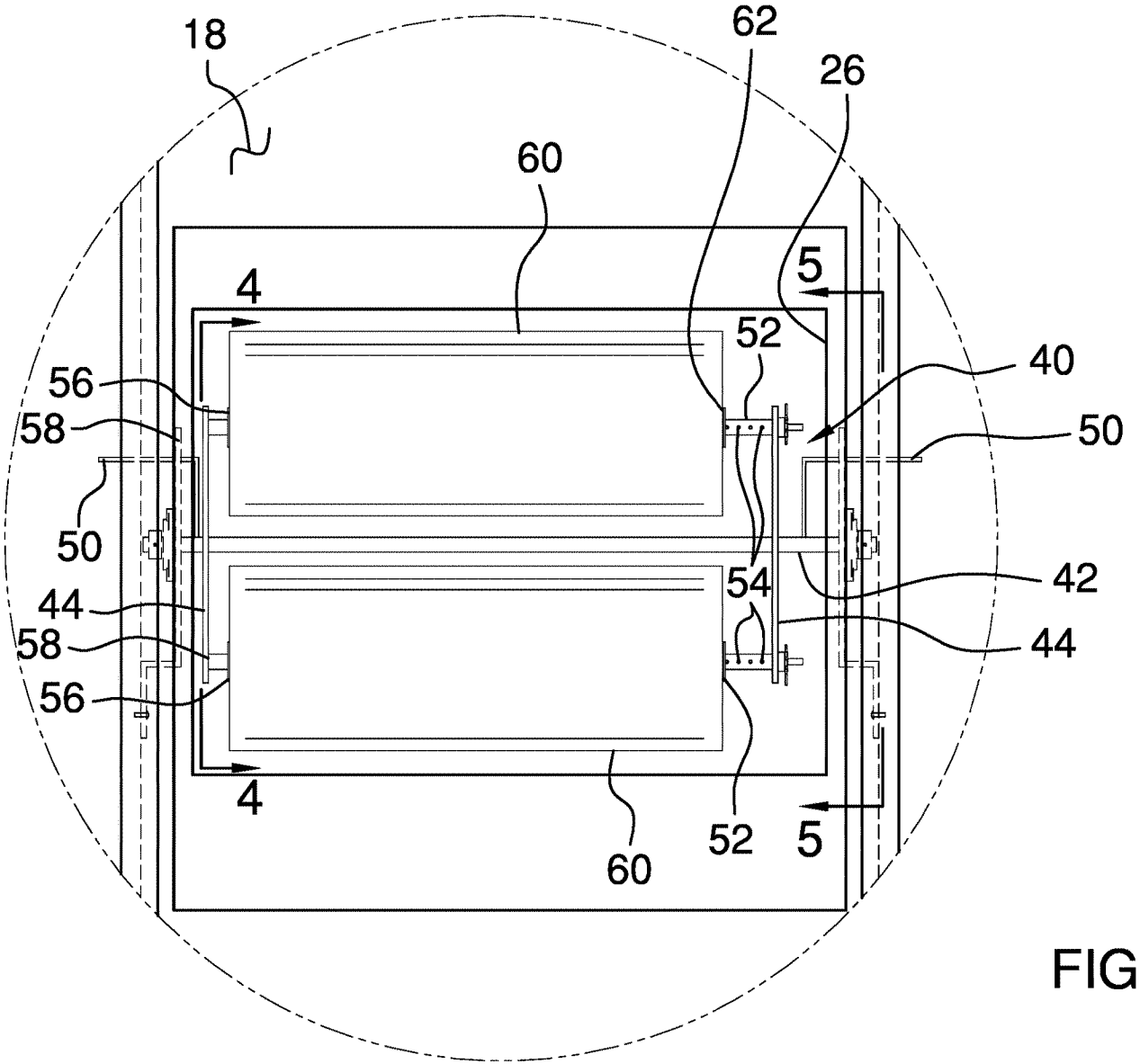
FIG. 3 is a top phantom view of a rocker unit of an embodiment of the disclosure.
Figure 4:
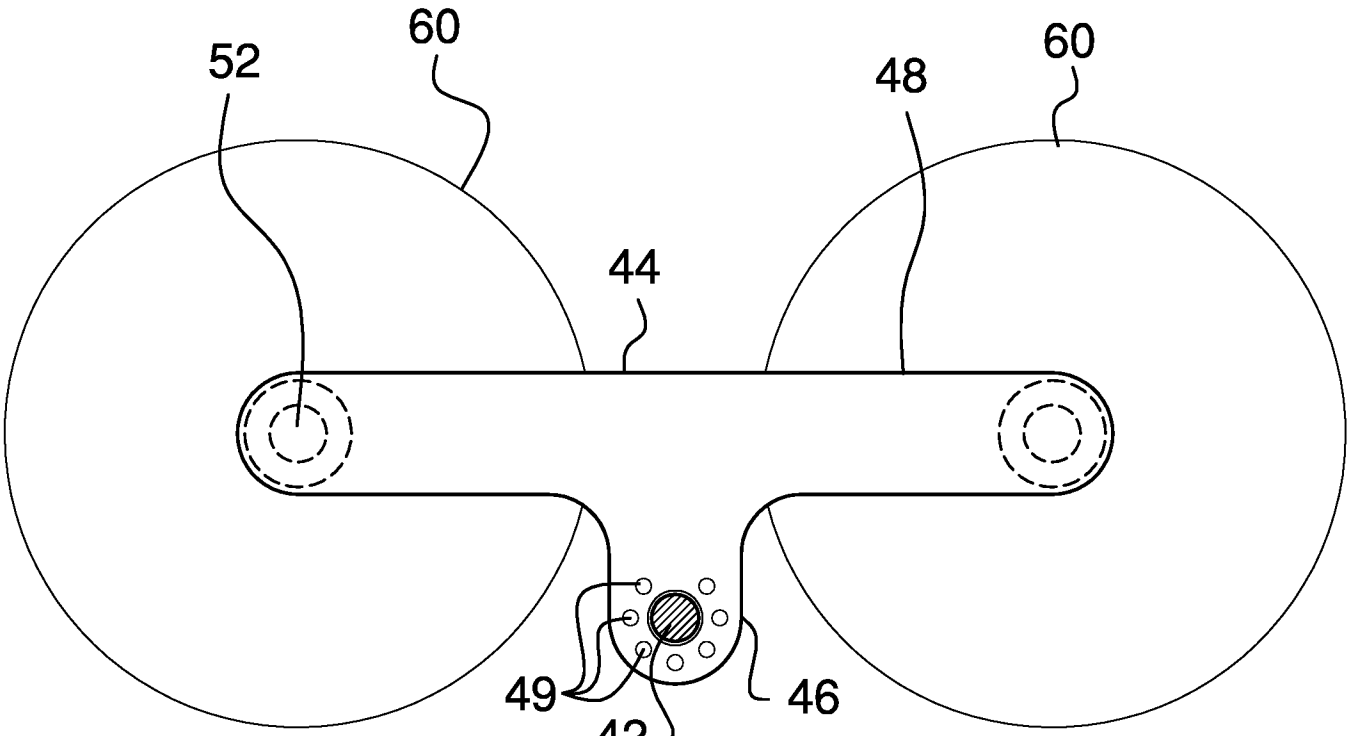
FIG. 4 is a cross sectional view taken along line 4-4 of FIG. 3 of an embodiment of the disclosure.
Figure 5:
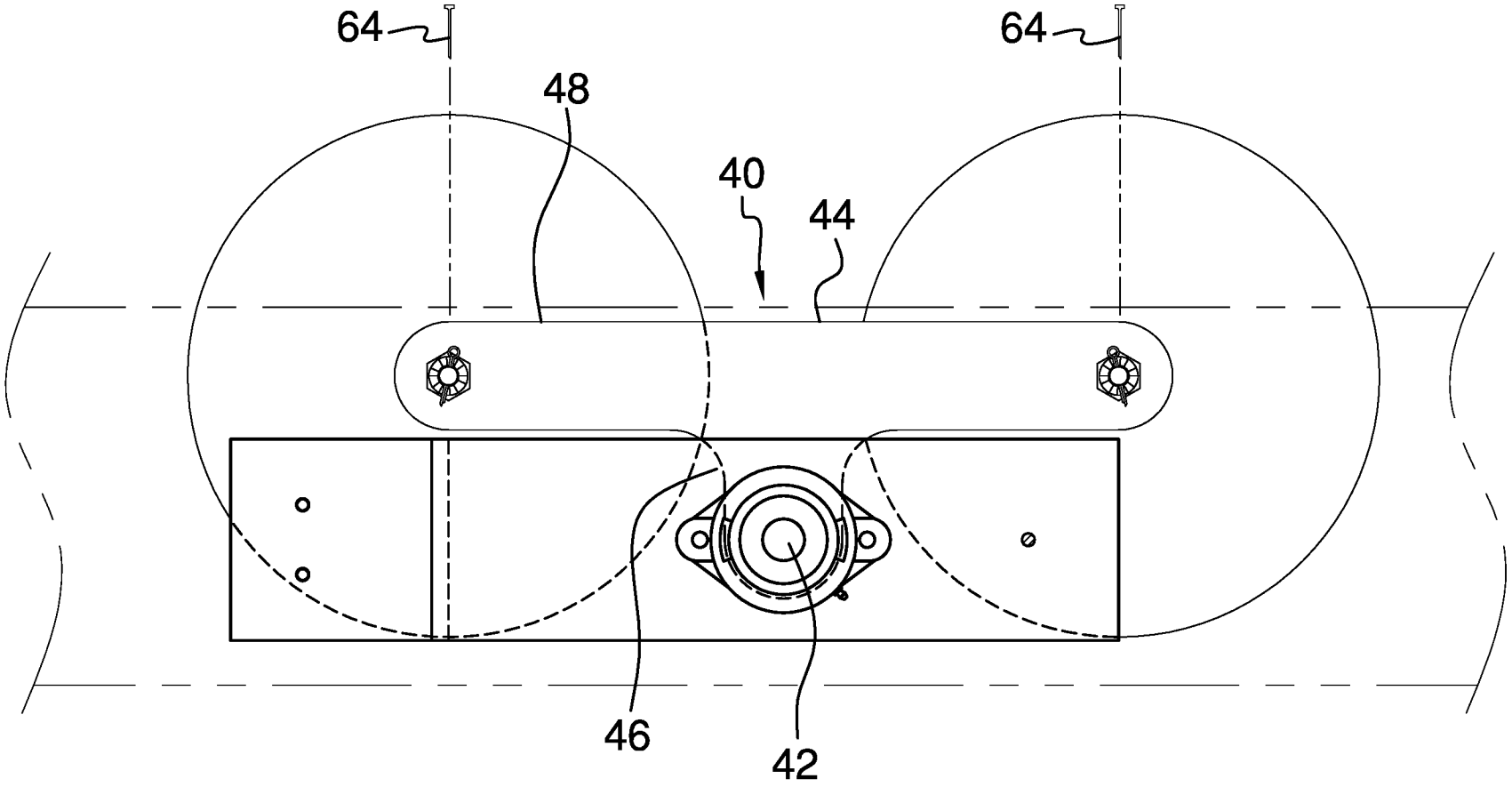
FIG. 5 is a cross sectional view taken along line 5-5 of FIG. 3 of an embodiment of the disclosure.

With reference now to the drawings, and in particular to FIGS. 1 through 5 thereof, a new massaging device embodying the principles and concepts of an embodiment of the disclosure and generally designated by the reference numeral 10 will be described.

As best illustrated in FIGS. 1 through 5, the massaging table assembly 10 generally comprises a table 12 that is positionable at an angle on a support surface 14 for having a user 16 lie thereon. The table 12 has a top surface 18, a bottom surface 20, a first end 22 and a second end 24. The table 12 is elongated between the first end 22 and the second end 24, and the table 12 has an opening 26 extending through the top surface 18 and the bottom surface 20. The opening 26 is positioned closer to the first end 22 than the second end 24. The bottom surface of the table 12 has a plurality of finger grips 21 each extending downwardly therefrom. The finger grips 21 are arranged into a pair of sets of fingers grips 21, and each of the sets of finger grips 21 is aligned with a respective first lateral side 23 or a second lateral side 25 of the table.

A pair of first legs 28 is each pivotally coupled to the table 12 to support the table 12 above the support surface 14. Each of the first legs 28 is positioned on the bottom surface 20 of the table 12 and each of the first legs 28 is positioned adjacent to the first end 22 of the table 12. Each of the first legs 28 is positionable in a deployed position having each of the first legs 28 extending downwardly from the table 12. Additionally, each of the first legs 28 is positionable in a folded position having each of the first legs 28 resting against the table 12.

Each of the first legs 28 comprises a first half 30 that slidably receives a second half 32 such that each of the first legs 28 has a telescopically adjustable 12 length. The first half 30 of each of the first legs 28 has a plurality of engagement points 34 thereon. The second half 32 of each of the first legs 28 has an engagement 36 thereon. The engagement 36 on the second half 32 of each of the first legs 28 engages a selected one of the engagement points 34 on the first half 30 of a respective one of the first legs 28. The engagement 36 may be a spring loaded lock or other similar movable engagement.

A pair of second legs 38 is each pivotally coupled to the table 12 support the table 12 above the support surface 14.

Each of the second legs 38 has a length that is less than the length of the first legs 28 thereby facilitating the table 12 to be positioned at an angle on the support surface 14. The support surface 14 may be a floor or other horizontal support surface. A rocker unit 40 is pivotally coupled to the table 12 and the rocker unit 40 is positioned in the opening 26 in the table 12. The rocker unit 40 is tiltable 12 to a variety of angles with respect to the table 12. The rocker unit 40 comprises a shaft 42 that is coupled to the table 12. The shaft 42 extends across the opening 26 in the table 12 and the shaft 42 is centrally positioned in the opening 26.

The rocker unit 40 includes a pair of rocker arms 44 that each has a lobe 46 extending downwardly from a member 48. The lobe 46 is centrally positioned on the member 48. The shaft 42 extends through the lobe 46 on each of each of the rocker arms 44 having the member 48 on each of the rocker arms 44 extending along a line oriented perpendicular to the shaft 42. Each of the rocker arms 44 is positioned adjacent to opposite ends of the shaft 42.

The lobe 46 on each of the rocker arms 44 has a plurality of engagement points 49 thereon. The engagement points 49 on the lobe 46 of each of the rocker arms 44 is spaced apart from each other and is distributed around the shaft 42. Each of the rocker arms 44 is rotatable 12 about the shaft 42 for positioning the member 48 of each of the rocker arms 44 at a variety of angles with respect to a horizontal plane. A pair of adjustment rods 50 is provided and each of the adjustment rods 50 extends through the table 12. Each of the adjustment rods 50 engages a selected one of the engagement points 49 in the lobe 46 of a respective one of the rocker arms 44. In this way each of the rocker arms 44 can be retained at a selected point of rotation about the shaft 42.

A pair of roller rods 52 is provided and each of the roller rods 52 extends between the member 48 of each of the rocker arms 44. The roller rods 52 are positioned adjacent to opposite ends of the member 48 with respect to each other. Additionally, each of the roller rods 52 has a plurality of pin apertures 54 extending therethrough. A pair of first stops 56 is each coupled to a respective one of the roller rods 52. Each of the first stops 56 is positioned adjacent to a first end 58 of the respective roller rod 52.

A pair of rollers 60 is each rotatably coupled to the rocker unit 40 to massage the user's 16 body when the user 16 lies on the table 12. Each of the rollers 60 is positioned around a respective one of the roller rods 52 and each of the rollers 60 is slidable in a first direction or a second direction along the respective roller rod 52. Each of the rollers 60 abuts a respective one of the first stops 56 when the rollers 60 are fully slid in the first direction. Additionally, each of the rollers 60 is spaced from the respective first stop when the rollers 60 are slid in the second direction. Each of the rollers 60 extends upwardly beyond the top surface 18 of the table 12.

A pair of second stops 62 is provided and each of the second stops 62 is removably coupled to a respective one of the roller rods 52. Each of the second stops 62 is aligned with a respective one of the pin apertures 54 in the respective roller rod 52. A pair of pins 64 is provided and each of the pins 64 is extendable through a respective one of the pin apertures 54 in a respective one of the roller rods 52. In this way each of the second stops 62 is retained at a selected point on the roller rods 52. Thus, the first stops 56 and the second stops 62 can accommodate rollers 60 that have a variety of lengths. A foot rest 66 may be movably coupled to the top surface 18 of the table 12 and the foot rest 66 may be positioned adjacent to the second end 24 of the table 12. Thus, the user's 16 feet may rest on the foot rest 66 when the user 16 lies on the table 12.

In use, the rocker unit 40 is tilted to the selected angle and each of the adjustment pins 64 is manipulated to engage a corresponding engagement point 48 on the respective rocker unit 40. In this way the rollers 60 can be positioned to focus greater pressure on either the user's 16 upper back or the user's 16 lower back when the user 16 lies on the table 12. The user 16 lies on the table 12 such that rollers 60 about the user's 16 upper and lower back. In this way the rollers 60 can apply pressure to strategic points on the user's 16 back associated with massage therapy. The user 16 grips each of the sets of finger grips 21 when the user 16 lies on the table 12 to assist the user 16 to slide back and forth on the table 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A massaging table assembly being configured to massage a user's body at strategic points on the user's body, said assembly comprising:

a table being positionable at an angle on a support surface wherein said table is configured to have a user lie thereon, said table having an opening therein, said table having a top surface, a bottom surface, a first end and a second end, said table being elongated between said first end and said second end, said opening in said table extending through said top surface and said bottom surface, said opening being positioned closer to said first end than said second end;

a rocker unit being pivotally coupled to said table, said rocker unit being positioned in said opening in said table, said rocker unit being tiltable to a variety of angles with respect to said table, wherein said rocker unit comprises a shaft being coupled to said table, said shaft extending across said opening in said table, said shaft being centrally positioned in said opening, a pair of rocker arms, each of said rocker arms having a lobe extending downwardly from a member, said lobe being centrally positioned on said member, said shaft extending through said lobe on each of said rocker arms having said member on each of said rocker arms extending along a line being oriented perpendicular to said shaft, each of said rocker arms being positioned adjacent to opposite ends of said shaft, wherein said lobe on each of said rocker arms has a plurality of engagement points thereon, said engagement points on said lobe of each of said rockers arms being spaced apart from each other and being distributed around said shaft, each of said rocker arms being rotatable about said shaft for positioning said member of each of said rocker arms at a variety of angles with respect to a horizontal plane, and a pair of an adjustment rods, each of said adjustment rods movably extending through said table, each of said adjustment rods engaging a selected one of said engagement points in said lobe of a respective one of said rocker arms for retaining said rocker arms at a selected point of rotation about said shaft; and a pair of rollers, each of said rollers being rotatably coupled to said rocker units wherein each of said rollers is configured to massage the user's body when the user lies on said table.

2. The assembly according to claim 1, further comprising a pair of first legs, each of said first legs being coupled to said table wherein each of said first legs is configured to support said table above the support surface, each of said first legs being positioned on said bottom surface of said table, each of said first legs being positioned adjacent to said first end of said table.

3. The assembly according to claim 2, wherein each of said first legs comprises a first half that slidably receives a second half such that each of said first legs has a telescopically adjustable length, said first half of each of said first legs having a plurality of engagement points thereon, said second half of each of said first legs having an engagement thereon, said engagement on said second half of each of said first legs engaging a selected one of said engagement points on said first half of a respective one of said first legs.

4. The assembly according to claim 3, further comprising a pair of second legs, each of said second legs being pivotally coupled to said table wherein each of said second legs is configured to support said table above the support surface, each of said second legs having a length being less than the length of said first legs thereby facilitating said table to be positioned at an angle on the support surface.

5. The assembly according to claim 1, further comprising a pair of roller rods, each of said roller rods extending between said member of each of said rocker arms, said roller rods being positioned adjacent to opposite ends of the member with respect to each other, each of said roller rods having a plurality of pin apertures extending therethrough.

6. The assembly according to claim 5, further comprising a pair of first stops, each of said first stops being coupled to a respective one of said roller rods, each of said first stops being positioned adjacent to a first end of said respective roller rod.

7. The assembly according to claim 6, wherein each of said rollers is positioned around a respective one of said roller rods, each of said rollers being slidable in a first direction or a second direction along said respective roller rod, each of said rollers abutting a respective one of said first stops when said rollers are fully slid in said first direction, each of said rollers being spaced from said respective first stop when said rollers are slid in said second direction.

8. The assembly according to claim 7, further comprising a pair of second stops, each of said second stops being removably coupled to a respective one of said roller rods, each of said second stops being aligned with a respective one of said pin apertures in said respective roller rod.

9. The assembly according to claim 8, further comprising a pair of pins, each of said pins being extendable through a respective one of said pin apertures in a respective one of said roller rods for retaining each of said second stops at a selected point on said roller rods.

10. A massaging table assembly being configured to massage a user's body at strategic points on the user's body, said assembly comprising:

a table being positionable at an angle on a support surface wherein said table is configured to have a user lie thereon, said table having a top surface, a bottom surface, a first end and a second end, said table being elongated between said first end and said second end, said table having an opening extending through said top surface and said bottom surface, said opening being positioned closer to said first end than said second end;

a pair of first legs, each of said first legs being pivotally coupled to said table wherein each of said first legs is configured to support said table above the support surface, each of said first legs being positioned on said bottom surface of said table, each of said first legs being positioned adjacent to said first end of said table, each of said first legs comprising a first half that slidably receives a second half such that each of said first legs has a telescopically adjustable length, said first half of each of said first legs having a plurality of engagement points thereon, said second half of each of said first legs having an engagement thereon, said engagement on said second half of each of said first legs engaging a selected one of said engagement points on said first half of a respective one of said first legs;

a pair of second legs, each of said second legs being pivotally coupled to said table wherein each of said second legs is configured to support said table above the support surface, each of said second legs having a length being less than the length of said first legs thereby facilitating said table to be positioned at an angle on the support surface;

a rocker unit being pivotally coupled to said table, said rocker unit being positioned in said opening in said table, said rocker unit being tiltable to a variety of angles with respect to said table, said rocker unit comprising:

a shaft being coupled to said table, said shaft extending across said opening in said table, said shaft being centrally positioned in said opening;

a pair of rocker arms, each of said rocker arms having a lobe extending downwardly from a member, said lobe being centrally positioned on said member, said shaft extending through said lobe on each of each of said rocker arms having said member on each of said rocker arms extending along a line being oriented perpendicular to said shaft, each of said rocker arms being positioned adjacent to opposite ends of said shaft, said lobe on each of said rocker arms having a plurality of engagement points thereon, said engagement points on said lobe of each of said rockers arms being spaced apart from each other and being distributed around said shaft, each of said rocker arms being rotatable about said shaft for positioning said member of each of said rocker arms at a variety of angles with respect to a horizontal plane; and a pair of an adjustment rods, each of said adjustment rods movably extending through said table, each of said adjustment rods engaging a selected one of said engagement points in said lobe of a respective one of said rocker arms for retaining said rocker arms at a selected point of rotation about said shaft;

a pair of roller rods, each of said roller rods extending between said member of each of said rocker arms, said roller rods being positioned adjacent to opposite ends of the member with respect to each other, each of said roller rods having a plurality of pin apertures extending therethrough;

a pair of first stops, each of said first stops being coupled to a respective one of said roller rods, each of said first stops being positioned adjacent to a first end of said respective roller rod;

a pair of rollers, each of said rollers being rotatably coupled to said rocker units wherein each of said rollers is configured to massage the user's body when the user lies on said table, each of said rollers being positioned around a respective one of said roller rods, each of said rollers being slidable in a first direction or a second direction along said respective roller rod, each of said rollers abutting a respective one of said first stops when said rollers are fully slid in said first direction, each of said rollers being spaced from said respective first stop when said rollers are slid in said second direction;

a pair of second stops, each of said second stops being removably coupled to a respective one of said roller rods, each of said second stops being aligned with a respective one of said pin apertures in said respective roller rod; and a pair of pins, each of said pins being extendable through a respective one of said pin apertures in a respective one of said roller rods for retaining each of said second stops at a selected point on said roller rods.

* * * * *